US008304176B2

(12) United States Patent
Horiuchi

(10) Patent No.: US 8,304,176 B2
(45) Date of Patent: Nov. 6, 2012

(54) METHOD OF MANUFACTURING LIQUID EJECTION HEAD

(75) Inventor: Isamu Horiuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/196,358

(22) Filed: Aug. 2, 2011

(65) Prior Publication Data

US 2012/0047736 A1 Mar. 1, 2012

(30) Foreign Application Priority Data

Aug. 25, 2010 (JP) ..... 2010-188425

(51) Int. Cl.
*B41J 2/16* (2006.01)

(52) U.S. Cl. ..... 430/320; 430/330; 430/394

(58) Field of Classification Search ..... None
See application file for complete search history.

(56) References Cited

U.S. PATENT DOCUMENTS 6,447,102 B1 9/2002 Chen et al.
7,985,532 B2 7/2011 Horiuchi
2003/0087199 A1* 5/2003 Kim et al. ..... 430/320
2004/0008239 A1* 1/2004 Kubota et al. ..... 347/65
2006/0172227 A1* 8/2006 Shaarawi et al. ..... 430/311
2007/0059531 A1* 3/2007 Park et al. ..... 428/413
2007/0076053 A1* 4/2007 Hart et al. ..... 347/47
2008/0309733 A1 12/2008 Horiuchi et al.

FOREIGN PATENT DOCUMENTS

JP 11-314371 A 11/1999

* cited by examiner

*Primary Examiner* — John A. McPherson
(74) *Attorney, Agent, or Firm* — Fitzpatrick, Cella, Harper & Scinto

(57) ABSTRACT

Provided is a method of manufacturing a liquid ejection head, the liquid ejection head including: a substrate having an energy generating element that generates energy for ejecting liquid; and a flow path forming member having, on an upper side of the energy generating element, an ejection orifice for ejecting the liquid and a bubble generating chamber communicated with the ejection orifice, the method including: preparing a negative photosensitive resin as a material constituting the flow path forming member; and performing first exposure treatment for forming a first image constituting a side wall of the bubble generating chamber and second exposure treatment for forming a second image constituting a side wall of the ejection orifice so that a side wall of the first image and a side wall of the second image cross each other diagonally.

11 Claims, 7 Drawing Sheets

METHOD OF MANUFACTURING LIQUID EJECTION HEAD

BACKGROUND OF THE INVENTION

1. Field of the Invention

The present invention relates to a method of manufacturing a liquid ejection head that ejects liquid. More preferably, the present invention relates to a method of manufacturing an ink jet recording head that performs recording by ejecting ink onto a recording medium to be recorded.

2. Description of the Related Art

An example of using a liquid ejection head that ejects liquid is an ink jet recording method that performs recording by ejecting ink onto a recording medium to be recorded. An ink jet recording head applied to the ink jet recording method generally includes fine ejection orifices, a liquid flow path, and multiple energy generating elements that are provided in a part of the liquid flow path for generating energy to be used for ejecting liquid. A conventional method of manufacturing such ink jet recording head is described in, for example, Japanese Patent Application Laid-Open No. H11-314371.

In Japanese Patent Application Laid-Open No. H11-314371, first, a flow path forming member whose sensitivity is lowered by adding an optical dye is placed on a substrate on which the energy generating elements are formed. Then, images of bubble generating chambers are formed up to a deep portion of the flow path forming member with high dosage exposure, and images of ejection orifice portions are formed from an upper layer to an arbitrary deep portion of the flow path forming member with low dosage exposure. Further, an unexposed portion of the flow path forming member is eluted to form the bubble forming chambers and the ejection orifices.

According to the above-mentioned manufacturing method described in Japanese Patent Application Laid-Open No. H11-314371, the height of the bubble generating chambers is controlled by an exposure amount, and the bubble generating chambers and the ejection orifices are formed in one material. Therefore, the height of the bubble generating chambers cannot be controlled with high precision. Further, the ejection orifice portions are patterned with an exposure amount at which spaces to be the bubble generating chambers are not cured, and hence, a sufficient exposure amount cannot be used, which may cause the flow path forming member around the ejection orifice portions to be cured insufficiently. Therefore, the ejection orifices may be deformed by long-term printing.

SUMMARY OF THE INVENTION

An object of the present invention is to provide a method of manufacturing a liquid ejection head in which the shape of bubble generating chambers is not varied depending upon an exposure amount, and a flow path forming member can be cured with a sufficient exposure amount so that the durability of the flow path forming member is high.

The present invention provides a method of manufacturing a liquid ejection head, the liquid ejection head including: a substrate having an energy generating element that generates energy for ejecting liquid; and a flow path forming member having, on an upper side of the energy generating element, an ejection orifice for ejecting the liquid, and a bubble generating chamber communicated with the ejection orifice, the method including: preparing a negative photosensitive resin as a material constituting the flow path forming member; and performing first exposure treatment for forming a first image constituting a side wall of the bubble generating chamber and second exposure treatment for forming a second image constituting a side wall of the ejection orifice so that a side wall of the first image and a side wall of the second image cross each other diagonally.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 7A:
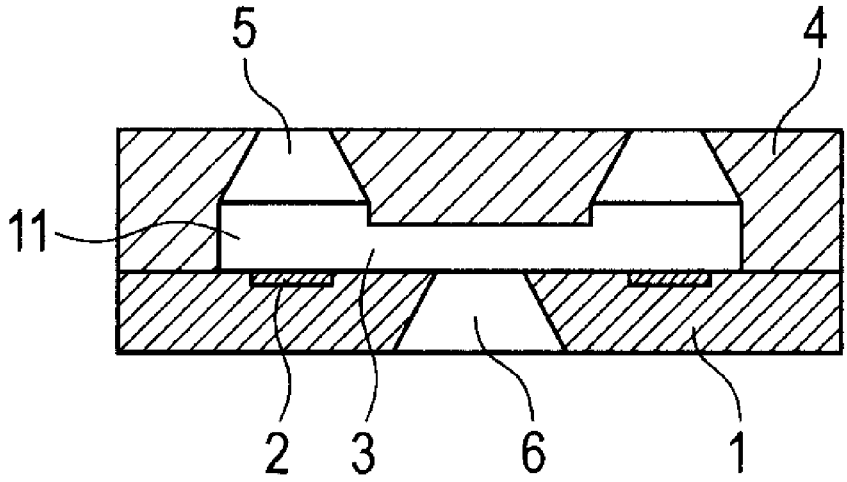
FIGS. 7A and 7B are schematic cross-sectional views taken along the line A-A of FIG. 1 for illustrating an exemplary configuration of a liquid ejection head.
Figure 7B:
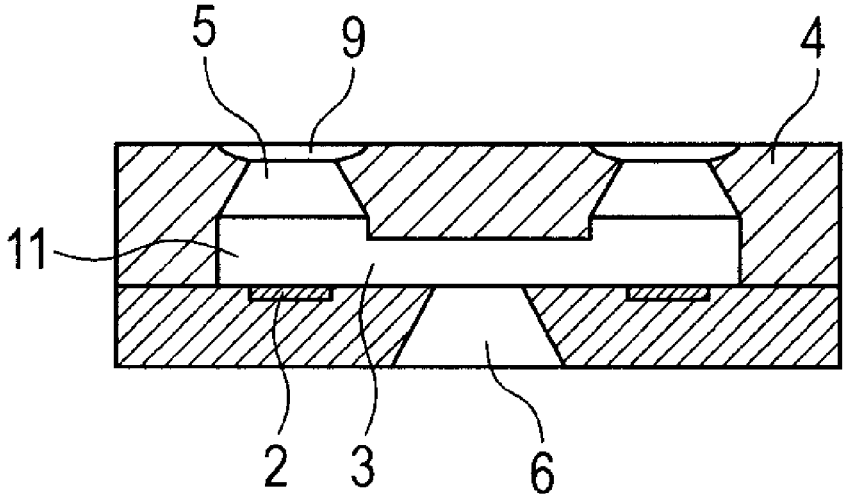

FIGS. 7A and 7B are schematic cross-sectional views illustrating an exemplary configuration of a liquid ejection head formed according to the present invention. In FIG. 7A, a substrate 1 made of silicon has energy generating elements 2 that generate energy for ejecting liquid. The substrate 1 also has a liquid supply opening 6 that is a through-hole for supplying liquid to a liquid flow path 3. On the substrate 1, a flow path forming member 4 is formed. The flow path forming member 4 contains the liquid flow path 3, bubble generating chambers 11, and ejection orifices 5, which are communicated with each other.

Both the ejection orifices 5 and the bubble generating chambers 11 are formed on an upper side of the energy generating elements 2. The side wall of each of the ejection orifices 5 is formed so as to diagonally extend upward from a side wall upper end of the bubble generating chamber 11 toward an upper end opening (hereinafter, referred to also as ejection orifice opening) of the ejection orifice 5. That is, the side wall of the ejection orifice 5 and the side wall of the bubble generating chamber 11 are formed continuously, and the ejection orifice 5 and the bubble generating chamber 11 are formed so that the lower end opening of the ejection orifice 5 and the upper end opening of the bubble generating chamber 11 have the same area. The ejection orifice opening is formed above the energy generating element 2 so as to correspond thereto.

In this specification, the upper side refers to the direction in which the opening of the ejection orifice is present, and the lower side refers to the direction in which a surface of the substrate opposite to a surface thereof on which the flow path forming member is placed is present.

The liquid is supplied from the liquid flow path 3 to the bubble generating chambers 11. In the bubble generating chambers 11, the liquid is subjected to the action of ejection energy generated by the energy generating elements 2 to be ejected out of the ejection orifices 5.

The side wall upper end of the bubble generating chamber 11 is formed on an upper side of an upper wall of the liquid flow path 3. Further, the side wall of the bubble generating chamber 11 is formed substantially in a perpendicular direction. That is, the side wall of the bubble generating chamber 11 is formed in a direction substantially perpendicular to a plane direction of the substrate 1. Then, the side wall of the ejection orifice is formed at an angle with respect to the direction perpendicular to the substrate and crosses the side wall of the bubble generating chamber 11 formed in the direction perpendicular to the substrate 1 in the flow path forming member 4. With such a configuration, the lower surface of the ejection orifice 5 and the upper surface of the bubble generating chamber 11 have the same area, and the bubble generating chambers 11 can be formed with a stable height, thereby obtaining a liquid ejection head with high durability of ejection orifices.

Further, as illustrated in FIG. 7B, a concave portion 9 may be provided in an upper surface of the flow path forming member 4 so that the ejection orifice opening may be formed at a bottom portion of the concave portion 9.

The side wall of the ejection orifice is formed so as to diagonally extend upward from the side wall upper end of the bubble generating chamber and so that the horizontal cross-section (cross-section taken along a plane parallel to the plane direction of the substrate) of the ejection orifice becomes smaller toward the ejection orifice opening. The shape of the cross-section of the ejection orifice perpendicular to the plane direction of the substrate is, for example, a trapezoid, as illustrated in FIGS. 7A and 7B. It is preferred that the side wall of the ejection orifice and the side wall of the bubble generating chamber abut against each other around the entire circumference.

In the present invention, a negative photosensitive resin is used as a material constituting the flow path forming member. As the negative photosensitive resin, for example, a cation-polymerizable photocurable resin can be used.

As used herein, an image is generally called an optical image, and refers to a region in which the shape of a mask is projected onto a material three-dimensionally by irradiation through the mask. In this specification, a region in which light is blocked by a mask is referred to as an image. That is, because a negative photosensitive resin is used as the flow path forming member, a portion to be dissolved in a development step after exposure is referred to as an image.

In the present invention, as described above, the flow path forming member of the liquid ejection head is formed so that the side wall of the ejection orifice and the side wall of the bubble generating chamber cross each other diagonally. That is, the side wall of the ejection orifice 5 is formed so as to diagonally extend upward from the side wall upper end of the bubble generating chamber 11 to the ejection orifice opening. In order to form the ejection orifice and the bubble generating chamber as described above, exposure treatment is performed twice in the present invention. For example, first, first exposure treatment for forming a first image constituting the side wall of the bubble generating chamber is performed. Then, second exposure treatment for forming a second image constituting the side wall of the ejection orifice is performed. At this time, by performing the second exposure treatment so that the side wall of the first image and the side wall of the second image cross each other diagonally, the side wall of the ejection orifice can be formed so as to diagonally extend upward from the side wall upper end of the bubble generating chamber to the ejection orifice opening. After that, development is performed to remove an unexposed portion. Further, the order of the first exposure treatment and the second exposure treatment is not limited to the above-mentioned order, and the first exposure treatment may be performed after the second exposure treatment. Thus, the order is not particularly limited.

At least a part of the side wall of the first image formed by the first exposure treatment becomes the side wall of the bubble generating chamber. That is, it is also considered that the side wall of the bubble generating chamber is formed by the first exposure treatment. Further, at least a part of the side wall of the second image formed by the second exposure treatment becomes the side wall of the ejection orifice. That is, it is also considered that the side wall of the ejection orifice is formed by the second exposure treatment.

Hereinafter, a method of exposing a negative photosensitive resin to light so that the side wall of the bubble generating chamber formed by the first exposure treatment and the side wall of the ejection orifice formed by the second exposure treatment cross each other diagonally is described by way of embodiments of the present invention.

(Embodiment 1)

This embodiment shows a method of forming a concave portion that functions as a concave lens in a negative photosensitive resin so as to refract incident light to allow the side wall of the ejection orifice to have an angle with respect to the direction perpendicular to the substrate. The concave portion functioning as a concave lens is formed by exposing the periphery of a portion to be a lens to light, and baking the negative photosensitive resin at a softening point of the resin in an uncured state, thereby causing the deformation so that the resin density is increased only in an unexposed portion. The depth of the concave portion at this time varies depending upon the conditions such as the coated film thickness of the negative photosensitive resin, the area of a concave lens to be formed, and the bake temperature. The concave portion becomes deeper as the coated film thickness is larger, the area of the concave lens is smaller, and the bake temperature is higher. In this embodiment, the depth of the concave portion is, for example, 1 to 10 μm. The cross-section of the concave portion has a shape similar to a parabola and can be approximated satisfactorily with a catenary curve.

Hereinafter, this embodiment is described in detail with reference to FIGS. 2A to 2H. In this specification, members denoted with the same reference numerals refer to the same members throughout the drawings.

Figure 2A:
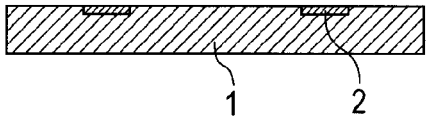
FIGS. 2A, 2B, 2C, 2D, 2E, 2F, 2G and 2H are cross-sectional views taken along the line A-A of FIG. 1 for illustrating an embodiment of a method of manufacturing a liquid ejection head.

First, as illustrated in FIG. 2A, a substrate 1 on which energy generating elements 2 for generating energy for ejecting liquid are placed is prepared.

Figure 2B:
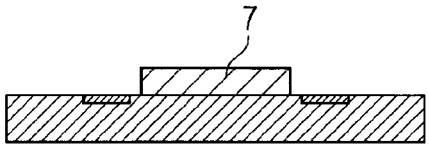

Next, as illustrated in FIG. 2B, a flow path pattern 7 to be a mold of a liquid flow path is formed using a soluble resin.

Figure 2C:
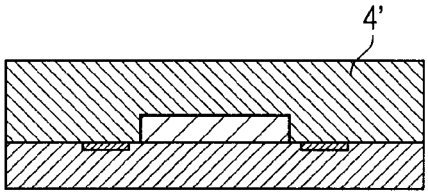

Next, as illustrated in FIG. 2C, a negative photosensitive resin 4' is applied onto the substrate 1 and the flow path pattern 7.

Figure 2D:
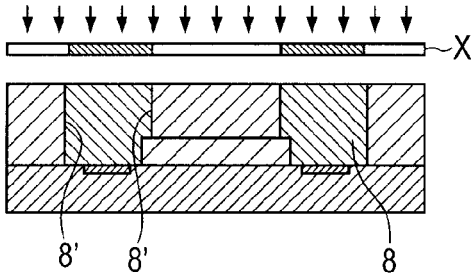

Next, as illustrated in FIG. 2D, a mask X having a pattern of a bubble generating chamber is used to expose the negative photosensitive resin 4' to light in a direction perpendicular to a plane direction with, for example, an I-ray exposure stepper, to thereby form first images 8. In the figure, a side wall 8' of the first image is illustrated. At least a part of the side wall of the first image becomes the side wall of the bubble generating chamber.

Figure 2E:
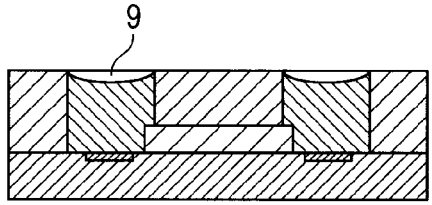

Next, as illustrated in FIG. 2E, a concave portion 9 is formed in an upper portion of the first image by heat treatment. The heat treatment is not particularly limited as long as the concave portion 9 is formed, and can be carried out, for example, at 110° C. for 4 minutes.

Figure 2F:
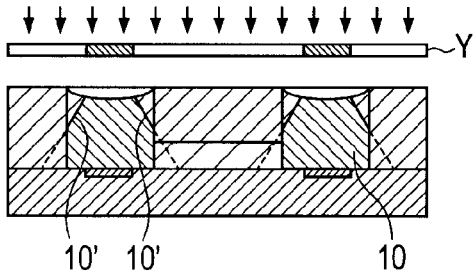

Next, as illustrated in FIG. 2F, a mask Y having a pattern in which portions corresponding to ejection orifices are covered is used to perform second exposure treatment so that a circular ejection orifice pattern is projected in the concave portion 9 to form a second image 10 with, for example, an I-ray exposure stepper. At this time, the concave portion 9 refracts incident light to allow the exposure light to have an angle with respect to the direction perpendicular to the substrate. Thus, the side wall of the ejection orifice can be formed in a diagonal direction. In the figure, a side wall 10' of the second image is illustrated. At least a part of the side wall of the second image becomes the side wall of the ejection orifice. More specifically, of the side wall of the second image, a portion other than the side wall of the first image formed in the first exposure treatment, that is, the side wall formed in a diagonal direction becomes the side wall of the ejection orifice.

Figure 2G:
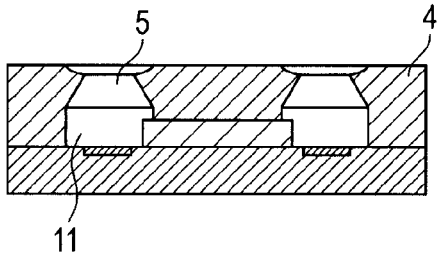

Next, as illustrated in FIG. 2G, heat treatment is performed, if required, and then, development is performed to form ejection orifices 5 and bubble generating chambers 11.

Figure 2H:
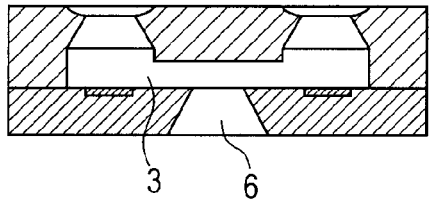

Next, as illustrated in FIG. 2H, a liquid supply opening 6 is formed. Further, a liquid flow path 3 is formed by dissolving and removing the flow path pattern 7.

After that, in order to cure the flow path forming member 4 completely, heat treatment is performed, and then, electrical connection and liquid supply unit are provided appropriately to manufacture a liquid ejection head.

In this embodiment, first, the side wall of the bubble generating chamber is formed by the first exposure treatment, and then, the side wall of the ejection orifice is formed in a diagonal direction by the second exposure treatment.

(Embodiment 2)

This embodiment shows a method of allowing the inside of a negative photosensitive resin to have an imaging position of a pattern at a time of exposure for an ejection orifice and allowing the side wall of the ejection orifice to have an angle with respect to a direction perpendicular to the substrate.

In projection exposure, an image of a mask is projected with the same dimensions of the mask at an imaging position. The image of the mask is blurred around the imaging position, and hence light enters the inner side (covered side) of the covered mask pattern to expose the inner side. By allowing the inside of the negative photosensitive resin to have an imaging position of the ejection orifice pattern, an image of the ejection orifice becomes maximum inside the negative photosensitive resin, which is the imaging position and an image is blurred on the surface layer positioned above the imaging position. Therefore, the image of the ejection orifice is exposed to light in a smaller range than the covered mask pattern. Thus, exposure is performed so that the area of the ejection orifice becomes larger as being closer to the imaging position inside the negative photosensitive resin from the upper layer thereof, and an image to be the side wall of the ejection orifice spreads toward the imaging position, to thereby provide the side wall with an angle with respect to the direction perpendicular to the substrate. The angle at this time varies depending upon the absorption and sensitivity with respect to the exposure wavelength of the negative photosensitive resin, and NA and δ of an exposure device.

Hereinafter, this embodiment is described in detail with reference to FIGS. 3A to 3D.

First, in the same way as in Embodiment 1, a substrate 1 on which a flow path pattern 7 and a negative photosensitive resin 4' are formed is prepared.

Figure 3A:
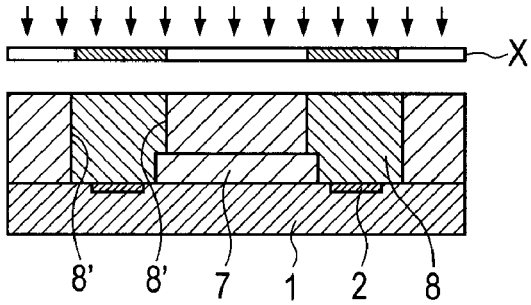
FIGS. 3A, 3B, 3C and 3D are cross-sectional views taken along the line A-A of FIG. 1 for illustrating an embodiment of the method of manufacturing a liquid ejection head.

Next, as illustrated in FIG. 3A, a mask X having a pattern of a bubble generating chamber is used to expose the negative photosensitive resin 4' to light in a direction perpendicular to a plane direction with, for example, an I-ray exposure stepper, to thereby form first images 8. In the figure, a side wall 8' of the first image is illustrated. At least a part of the side wall of the first image becomes the side wall of the bubble generating chamber.

Figure 3B:
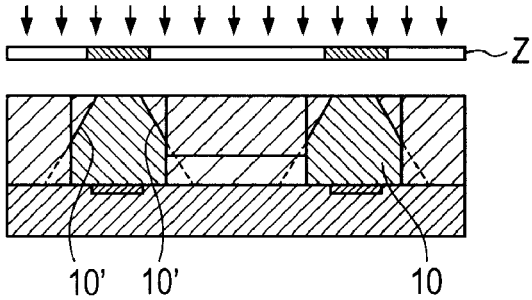

Next, as illustrated in FIG. 3B, a mask Z having a pattern in which portions corresponding to ejection orifices are covered is used to perform second exposure treatment with, for example, an I-ray exposure stepper. The imaging position at this time is desirably 10 to 70 μm to the inner portion from the surface layer of the negative photosensitive resin.

The exposure light is allowed to have an angle with respect to the direction perpendicular to the substrate, and thus, the side wall of the ejection orifice can be formed in a diagonal direction. In the figure, a side wall 10' of the second image is illustrated. Of the side wall of the second image, a side wall portion in a diagonal direction becomes the side wall of the ejection orifice.

Figure 3C:
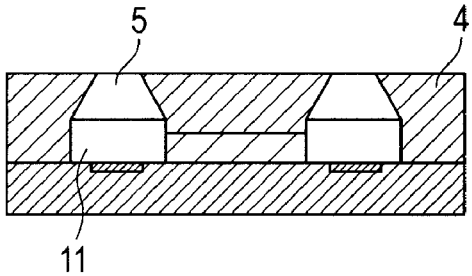

Next, as illustrated in FIG. 3C, heat treatment is performed, if required, and then, development is performed to form ejection orifices 5 and bubble generating chambers 11.

Figure 3D:
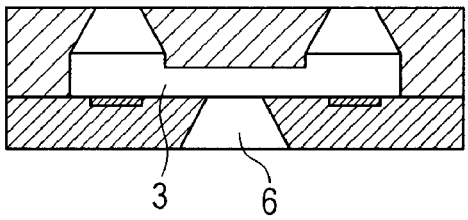

Next, as illustrated in FIG. 3D, a liquid supply opening 6 is formed. Further, a liquid flow path 3 is formed by dissolving and removing the flow path pattern 7.

After that, in order to cure the flow path forming member 4 completely, heat treatment is performed, and then, electrical connection and liquid supply unit are provided appropriately to manufacture a liquid ejection head.

Figure 4A:
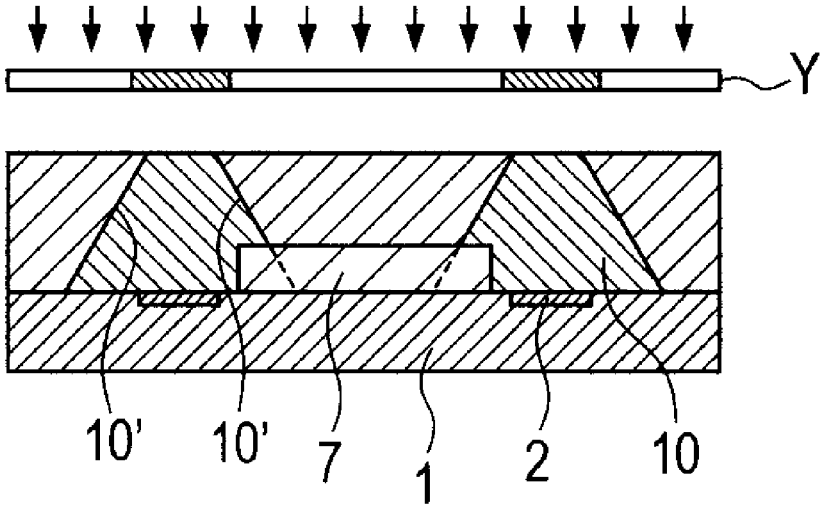
FIGS. 4A and 4B are cross-sectional views taken along the line A-A of FIG. 1 for illustrating an embodiment of the method of manufacturing a liquid ejection head.
Figure 4B:
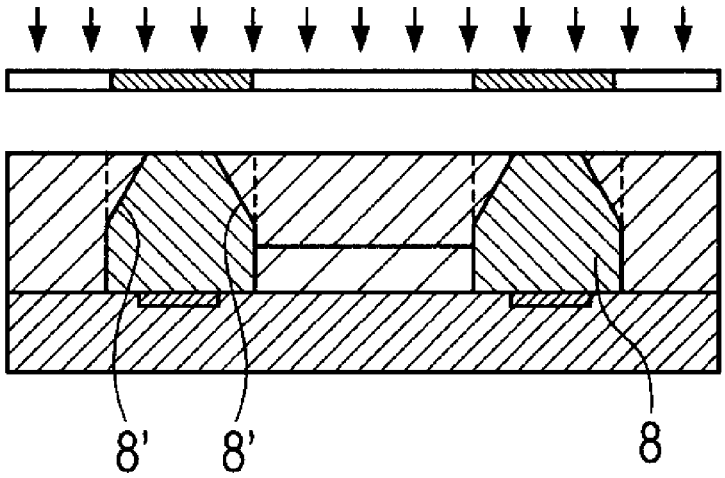

In this embodiment, first, the side wall of the bubble generating chamber is formed by the first exposure treatment, and then, the side wall of the ejection orifice is formed in a diagonal direction by the second exposure treatment. However, the first exposure treatment may be performed after the second exposure treatment. That is, as illustrated in FIGS. 4A and 4B, first, the side wall of the ejection orifice may be formed by the second exposure treatment, and then, the side wall of the bubble generating chamber may be formed by the first exposure treatment. After that, development is performed.

Further, in this embodiment, it is preferred to use a negative photosensitive resin with high sensitivity having an absorbance with respect to an exposure wavelength. Light entering the inner side (covered side) of the ejection orifice pattern covered with a mask has smaller light intensity compared with other incident light. Therefore, a negative photosensitive resin with low sensitivity is dissolved in a development step without being cured with the light. However, a negative photosensitive resin with high sensitivity can be cured with light entering the inner side. As a method of enhancing the sensitivity of the negative photosensitive resin, there is known a method in which a photosensitizer having an absorbance with respect to an exposure wavelength is added to the negative photosensitive resin. As a preferred embodiment, a photosensitizer is added, which has the function of increasing sensitivity in a range of 0.03 to 0.07/μm of an absorbance of the negative photosensitive resin with respect to the exposure wavelength. By setting the absorbance with respect to the exposure wavelength to 0.07/μm or less, the absorption in the surface layer of the negative photosensitive resin is prevented from increasing to enhance the sensitivity too much, and the ejection orifice can be prevented from being closed in the development step. Further, by setting the absorbance with respect to the exposure wavelength to 0.03/μm or more, a desired shape can easily be formed.

Figure 1:
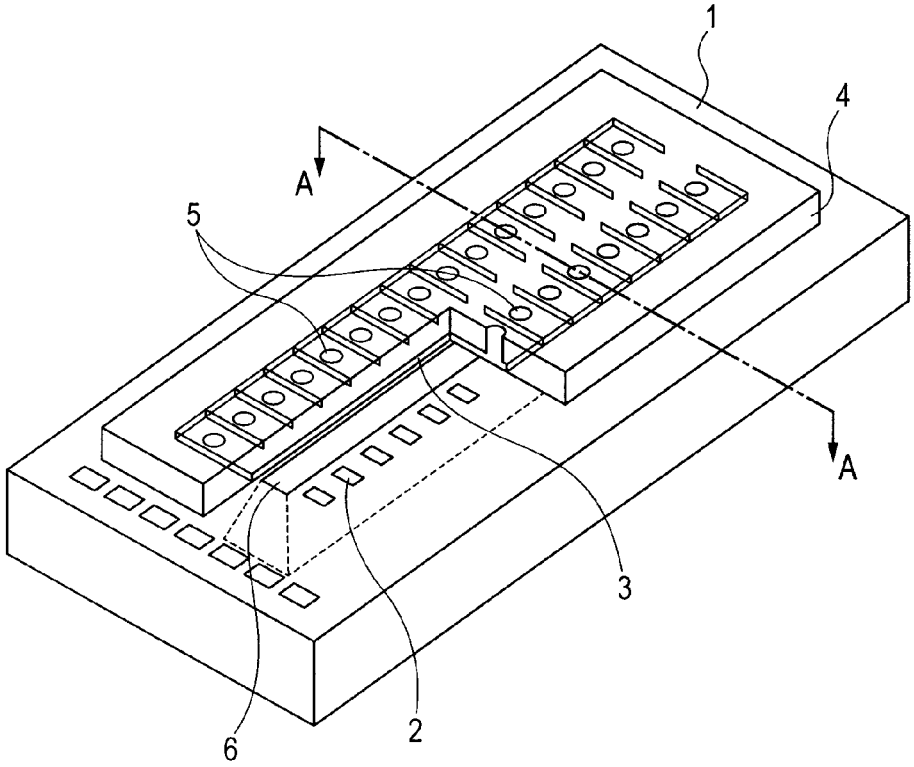
FIG. 1 is a schematic perspective view illustrating an exemplary configuration of a liquid ejection head.

Hereinafter, examples of the present invention are described. FIG. 1 is a schematic perspective view of an ink jet recording head in which energy generating elements 2 for generating energy for ejecting ink, a flow path forming member 4 covering an ink flow path 3, ejection orifices 5, and an ink supply opening 6 are placed on a substrate 1. Hereinafter, a method of manufacturing an ink jet recording head is described by way of the steps of forming an ink jet recording head with reference to the cross-section taken along the line A-A of FIG. 1. In the following examples, an ink jet recording head is described as an application example of the present invention. However, the application range of the present invention is not limited thereto, and the present invention can also be applied to a liquid ejection head for manufacturing a biochip and electronic circuit printing. Examples of the liquid ejection head include a head for manufacturing a color filter as well as an ink jet recording head.

EXAMPLE 1

In this example, an ink jet recording head was manufactured by the steps of FIGS. 2A to 2H.

First, as illustrated in FIG. 2A, a substrate 1 on which energy generating elements 2 for generating energy for ejecting ink were placed was prepared.

Next, as illustrated in FIG. 2B, polymethylisopropenylketone (ODUR-1010 (trade name) manufactured by TOKYO OHKA KOGYO CO., LTD.) was applied onto the substrate 1 in a thickness of 10 μm. The resultant substrate 1 was subjected to exposure and development to form an ink flow path pattern 7 to be a mold of an ink flow path. For the exposure, an exposure device UX3000 (manufactured by USHIO INC.) was used.

Next, as illustrated in FIG. 2C, a resin composition 4' formed of materials shown in Table 1 was applied onto the ink flow path pattern 7 in a thickness of 40 μm from the substrate 1, followed by heat treatment at 60° C. for 9 minutes.

TABLE 1

| | | |
|---|---|---|
| Epoxy resin | EHPE-3150, DAICEL CHEMICAL INDUSTRIES, LTD. | 100 parts |
| Additive | 1,4-HFAB, Central Glass Co., Ltd. | 20 parts |
| Cation-polymerizable initiator | SP-172, ADEKA | 6 parts |
| Silane coupling agent | A-187, GE Toshiba Silicone Co., Ltd. | 5 parts |
| Solvent | Xylene, KISHIDA CHEMICAL Co., Ltd. | 70 parts |

Next, as illustrated in FIG. 2D, a pattern (30×30 μm) (not shown) of a bubble generating chamber was exposed to light of 2,500 J/m$^2$, using an I-ray exposure stepper (manufactured by Canon Inc.), to form a first image 8, to thereby form the side wall of the bubble generating chamber. In the figure, a side wall 8' of the first image is illustrated.

Next, as illustrated in FIG. 2E, the resultant substrate 1 was heat-treated at 110° C. for 4 minutes to form a concave portion 9 in an upper portion of the first image.

Next, as illustrated in FIG. 2F, a pattern (not shown) of an ejection orifice was exposed to light of 4,000 J/m$^2$, using an I-ray exposure stepper (manufactured by Canon Inc.), to form a second image 10, to thereby form the side wall of the ejection orifice. In the figure, a side wall 10' of the second image is illustrated. In addition, the opening of the ejection orifice was set to Φ18 μm.

Then, the substrate 1 was heat-treated at 90° C. for 4 minutes and developed with xylene/methyl isobutyl ketone=6/4 as illustrated in FIG. 2G to form a flow path forming member 4 having ejection orifices 5 and bubble generating chambers 11.

Next, as illustrated in FIG. 2H, a mask for manufacturing an ink supply opening was placed appropriately on a back surface of the substrate 1, and an ink supply opening 6 was formed by anisotropic etching of the silicon substrate. The surface of the substrate was protected with a protective film. After that, the protective film was removed. Further, the entire surface was irradiated with a UV-ray using UX3000 (manufactured by USHIO INC.) to dissolve the ink flow path pattern 7. Then, the ink flow path pattern 7 was dissolved and removed using methyl lactate to form an ink flow path 3.

After that, in order to cure the flow path forming member 4 completely, a heating process was performed at 200° C. for one hour. Then, electrical connection and an ink supply unit were provided appropriately to manufacture an ink jet recording head.

EXAMPLE 2

In this example, an ink jet recording head was manufactured by the steps of FIGS. 3A to 3D.

First, an ink flow path pattern 7 was formed on a substrate 1 in the same way as in Example 1. Then, a resin composition 4' shown in Table 2 was applied onto the ink flow path pattern 7 to a thickness of 40 μm from the substrate 1 and then heat-treated at 90° C. for 3 minutes.

TABLE 2

| | | |
|---|---|---|
| Epoxy resin | EHPE-3150, DAICEL CHEMICAL INDUSTRIES, LTD. | 100 parts |
| Additive | 1,4-HFAB, Central Glass Co., Ltd. | 20 parts |
| Cation-polymerizable initiator | SP-172, ADEKA | 6 parts |
| Photosensitizing catalyst | SP-100, ADEKA | 2 parts |
| Reaction inhibitor | Triethanolamine, KISHIDA CHEMICAL Co., Ltd. | 0.15 part |
| Silane coupling agent | A-187, GE Toshiba Silicone Co. Ltd. | 5 parts |
| Solvent | Xylene, KISHIDA CHEMICAL Co. | 70 parts |

Next, as illustrated in FIG. 3A, a pattern (30×30 μm) of a bubble generating chamber was exposed to light of 8,000 J/m$^2$, using an I-ray exposure stepper (manufactured by Canon Inc.), to form a first image 8, to thereby form the side wall of the bubble generating chamber. In the figure, a side wall 8' of the first image is illustrated.

Next, as illustrated in FIG. 3B, the imaging position of the I-ray exposure stepper (manufactured by Canon Inc.) was set to a position of 50 μm from the surface of the flow path forming member 4 to the substrate 1 side, and the pattern of the ejection orifice was exposed to light of 5,000 J/m$^2$ to form a second image 10, to thereby form the side wall of the ejection orifice. In the figure, a side wall 10' of the second image is illustrated. The opening of the ejection orifice was set to 018 μm.

Then, as illustrated in FIG. 3C, the substrate 1 was heat-treated at 90° C. for 4 minutes and developed with xylene/methyl isobutyl ketone=6/4 to form ejection orifices 5 and bubble generating chambers 11.

Next, as illustrated in FIG. 3D, an ink supply opening 6 was formed in the same way as in Example 1, and then, the ink flow path pattern 7 was dissolved and removed to form an ink flow path 3.

After that, the flow path forming member 4 was cured completely, and then electrical connection and an ink supply unit were provided appropriately to manufacture an ink jet recording head.

EXAMPLE 3

In this example, an ink jet recording head was manufactured using the steps of FIGS. 4A and 4B. In this example, the exposure order of the bubble generating chamber and the ejection orifice was reversed compared with that of Example 2, with the other steps unchanged.

First, an ink flow path pattern 7 was formed on a substrate 1. Then, as illustrated in FIG. 4A, a focus of an I-ray exposure stepper (manufactured by Canon, Inc.) was set to a position of 50 μm from the surface of a flow path forming member 4 to the substrate 1 side, and a pattern of an ejection orifice was exposed to light of 5,000 J/m$^2$ to form a second image 10, to thereby form the side wall of the ejection orifice. A side wall 10' of the second image is illustrated, a part of which is to be the side wall of the ejection orifice.

Next, as illustrated in FIG. 4B, a pattern of a bubble generating chamber was exposed to light of 8,000 J/m$^2$ to form a first image 8, to thereby form the side wall of the bubble generating chamber.

Then, an ejection orifice 5 and a bubble generating chamber 11 were formed in the same way as in Example 2. Further, after the ink supply opening 6 was formed, the ink flow path pattern 7 was dissolved and removed and the flow path forming member 4 was cured completely. Electrical connection and an ink supply unit were provided appropriately to manufacture an ink jet recording head.

EXAMPLE 4

In this example, an ink jet recording head was manufactured by the steps of FIGS. 5A to 5G.

First, an ink flow path pattern 7 was formed on a substrate 1 in the same way as in Example 1.

Figure 5A:
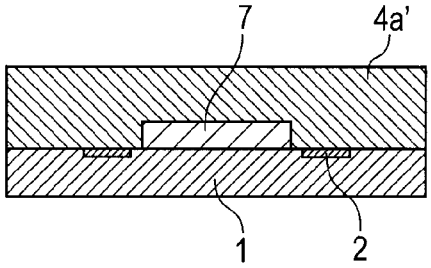
FIGS. 5A, 5B, 5C, 5D, 5E, 5F and 5G are cross-sectional views taken along the line A-A of FIG. 1 for illustrating an embodiment of the method of manufacturing a liquid ejection head.

Next, as illustrated in FIG. 5A, a resin composition (first negative photosensitive resin) 4*a*' formed of materials shown in Table 2 was applied onto the ink flow path pattern 7 at a thickness of 15 μm from the substrate 1, followed by heat treatment at 90° C. for 5 minutes.

Figure 5B:
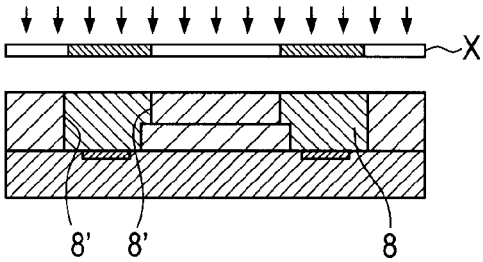

Next, as illustrated in FIG. 5B, a pattern (30×30 μm) of a bubble generating chamber was exposed to light of 3,500 J/m$^2$, using an I-ray exposure stepper (manufactured by Canon Inc.), to form a first image 8, to thereby form the side wall of the bubble generating chamber. In the figure, a side wall 8' of the first image is illustrated, which is to be the side wall of the bubble generating chamber.

Figure 5C:
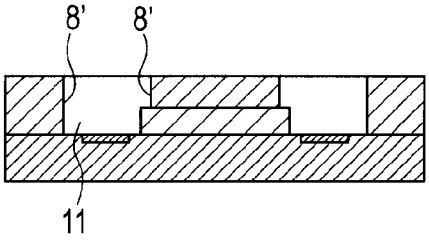

Then, as illustrated in FIG. 5C, the substrate 1 was heat-treated at 90° C. for 4 minutes and developed with xylene/methyl isobutyl ketone=6/4 to form bubble generating chambers 11.

Figure 5D:
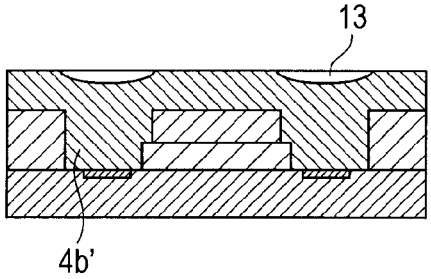

Next, as illustrated in FIG. 5D, a resin composition (second negative photosensitive resin) 4*b*' shown in Table 2 was applied onto the bubble generating chambers 11 to a thickness of 15 μm. Then, the resultant substrate 1 was heat-treated at 90° C. for 5 minutes to form concave portions 13 in the second negative photosensitive resin above the bubble generating chambers 11.

Figure 5E:
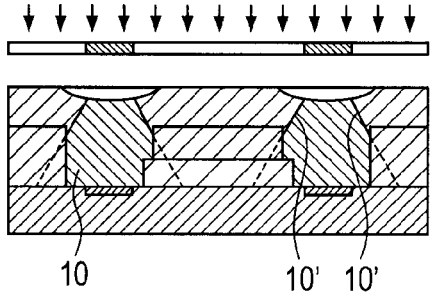

Next, as illustrated in FIG. 5E, a pattern (Φ18 μm) of an ejection orifice was exposed to light of 4,000 J/m$^2$, using an I-ray exposure stepper (manufactured by Canon Inc.), to form a second image 10, to thereby form the side wall of the ejection orifice. In the figure, a side wall 10' of the second image is illustrated, which is to be the side wall of the ejection orifice.

Figure 5F:
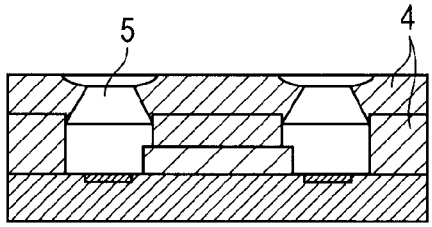

Then, as illustrated in FIG. 5F, the substrate 1 was heat-treated at 90° C. for 4 minutes and developed with xylene/methyl isobutyl ketone=6/4 to form ejection orifices 5.

Figure 5G:
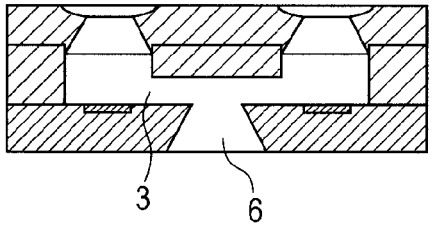

Next, as illustrated in FIG. 5G, an ink supply opening 6 was manufactured in the same way as in Example 1. Then, the ink flow path pattern 7 was dissolved and removed to form an ink flow path 3.

Then, after the lower flow path forming member 4*a* and the upper flow path forming member 4*b* were cured completely, electrical connection and an ink supply unit were provided appropriately to manufacture an ink jet recording head.

COMPARATIVE EXAMPLE

For comparison, an ink jet recording head was manufactured in which the area of the lower surface of an ejection orifice was different from the area of the upper surface of a bubble generating chamber. This comparative example is described with reference to FIGS. 6A to 6F.

Figure 6A:
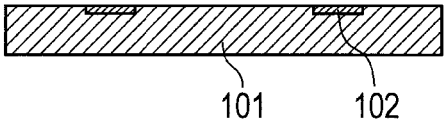
FIGS. 6A, 6B, 6C, 6D, 6E and 6F are views taken along the line A-A of FIG. 1 for illustrating an example of a conventional method of manufacturing an ink jet head.

First, as illustrated in FIG. 6A, a substrate 101 on which energy generating elements 102 for generating energy for ejecting ink were placed was prepared.

Figure 6D:
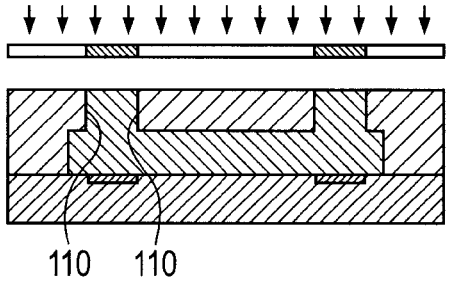
Figure 6B:
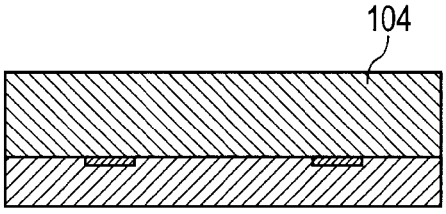

Next, as illustrated in FIG. 6B, a resin composition (cation-polymerizable photocurable resin) shown in Table 3 was applied to a thickness of 30 μm from the substrate 101 and then heat-treated at 90° C. for 5 minutes to form a negative photosensitive resin layer 104.

TABLE 3

| | | |
|---|---|---|
| Epoxy resin | EHPE-3150, DAICEL CHEMICAL INDUSTRIES, LTD. | 100 parts |
| Additive | 1,4-HFAB, Central Glass Co., Ltd. | 20 parts |
| Cation-polymerizable initiator | SP-172, ADEKA | 6 parts |
| Photosensitizing catalyst | SP-100, ADEKA | 2.9 parts |
| Reaction inhibitor | Triethanolamine, KISHIDA CHEMICAL Co., Ltd. | 0.099 part |
| Silane coupling agent | A-187, GE Toshiba Silicone Co., Ltd. | 5 parts |
| Solvent | Xylene, KISHIDA CHEMICAL Co., Ltd. | 70 parts |

Figure 6E:
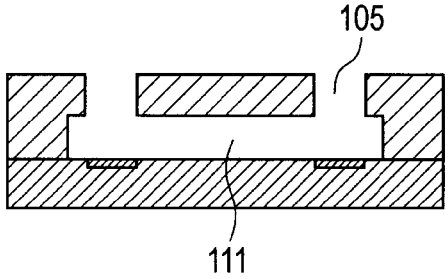
Figure 6C:
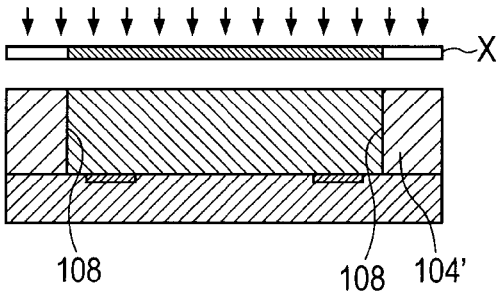

Next, as illustrated in FIG. 6C, a pattern of a bubble generating chamber was exposed to light of 8,000 J/m$^2$, using an I-ray exposure stepper (manufactured by Canon Inc.), to form an image of a side wall 108 of the bubble generating chamber. In the figure, a cured part 104' of the negative photosensitive resin is illustrated.

Next, as illustrated in FIG. 6D, a pattern (Φ18 μm) of an ejection orifice was exposed to light of 1,200 J/m$^2$, using an I-ray exposure stepper (manufactured by Canon Inc.), to form an image of a side wall 110 of the ejection orifice.

Then, as illustrated in FIG. 6E, the substrate 1 was heat-treated at 90° C. for 4 minutes and developed with xylene/methyl isobutyl ketone=6/4 to form ejection orifices 105 and bubble generating chambers.

Figure 6F:
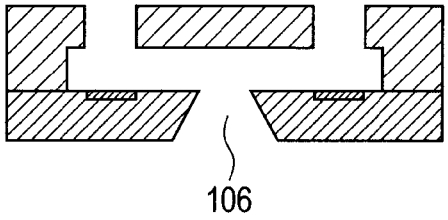

Next, as illustrated in FIG. 6F, a mask for manufacturing a rear portion of an ink supply opening was placed appropriately on a back surface of the substrate, and an ink supply opening 106 was formed by anisotropic etching of the silicon substrate. The surface of the substrate was protected with a protective film. Further, the entire surface was irradiated with a UV-ray using UX3000 (manufactured by USHIO INC.) to dissolve and remove the flow path forming member, to thereby form an ink flow path 111. After that, in order to cure the flow path forming member completely, a heating process was performed at 200° C. for one hour. Then, electrical connection and an ink supply unit were provided appropriately to manufacture an ink jet recording head.

(Evaluation)

The cross-sectional shapes of the ejection orifice and the bubble generating chamber of each ink jet recording head manufactured in the above-mentioned examples was observed to confirm that the connecting portion between the ejection orifice and the bubble generating chamber was formed with the same area.

In the ink jet recording head manufactured in the comparative example, the exposure amount for forming the ejection orifice was small, and therefore, the flow path forming member was not cured sufficiently, and the shapes of the bubble generating chamber and the ejection orifice were deformed in the development step. Although the deformation was prevented by increasing the exposure amount, a desired height of the bubble generating chamber was not obtained.

On the other hand, in the ink jet recording heads manufactured in the above-mentioned examples, even when the ejection orifice was patterned with an exposure amount required for curing, the shape of the bubble generating chamber was not changed largely. Thus, it was confirmed that the bubble generating chamber and the ejection orifice were able to be manufactured with high precision.

The ink jet recording heads manufactured in those examples were filled with black ink, and printing was performed with respect to A4-sized recording sheets continuously. A state of high printing quality was maintained even in long-term printing.

According to the configuration of the present invention, the bubble generating chamber can be formed without changing the shape thereof depending upon an exposure amount, and a liquid ejection head with high durability of orifice portions can be manufactured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-188425, filed Aug. 25, 2010, which is hereby incorporated by reference herein in its entirety.

What is claimed is:

1. A method of manufacturing a liquid ejection head, the liquid ejection head including: a substrate having an energy generating element that generates energy for ejecting liquid; and a flow path forming member having, on an upper side of the energy generating element, an ejection orifice for ejecting the liquid and a bubble generating chamber communicated with the ejection orifice, the method comprising:

preparing a negative photosensitive resin as a material constituting the flow path forming member; and performing first exposure treatment for forming a first image constituting a side wall of the bubble generating chamber and second exposure treatment for forming a second image constituting a side wall of the ejection orifice so that a side wall of the first image and a side wall of the second image cross each other diagonally.

2. The method of manufacturing a liquid ejection head according to claim 1, wherein the ejection orifice and the bubble generating chamber are formed so that the side wall of the ejection orifice diagonally extends upward from a side wall upper end of the bubble generating chamber and that a horizontal cross-section of the ejection orifice becomes smaller toward an upper end opening of the ejection orifice.

3. The method of manufacturing a liquid ejection head according to claim 1, wherein the ejection orifice and the bubble generating chamber are formed so that an area of a lower end opening of the ejection orifice is the same as an area of an upper end opening of the bubble generating chamber.

4. The method of manufacturing a liquid ejection head according to claim 1, comprising in this order:

(1) placing the negative photosensitive resin onto the substrate;

(2) performing the first exposure treatment;

(3) performing the second exposure treatment so that the side wall of the first image and the side wall of the second image cross each other diagonally; and (4) developing the negative photosensitive resin.

5. The method of manufacturing a liquid ejection head according to claim 4, further comprising, after the performing the first exposure treatment and before the performing the second exposure treatment, forming a concave portion in an upper portion of the first image by heat-treating the negative photosensitive resin at a temperature equal to or higher than a softening point of the negative photosensitive resin, wherein the second exposure treatment comprises a process of exposing the negative photosensitive resin to light to form the second image in the concave portion.

6. A method of manufacturing a liquid ejection head according to claim 1, wherein the second exposure treatment comprises a process of exposing the negative photosensitive resin to light while an imaging position of the second exposure treatment is set inside the negative photosensitive resin so that the side wall of the first image and the side wall of the second image cross each other inside the negative photosensitive resin.

7. The method of manufacturing a liquid ejection head according to claim 1, comprising:

placing a first negative photosensitive resin constituting a lower portion of the flow path forming member, onto the substrate;

exposing the first negative photosensitive resin to light to form the first image, and thereafter, developing the first image to form the bubble generating chamber having the side wall of the first image;

placing a second negative photosensitive resin constituting an upper portion of the flow path forming member, onto the lower portion of the flow path forming member and inside the bubble generating chamber;

heat-treating the second negative photosensitive resin at a temperature equal to or higher than a softening point of the second negative photosensitive resin to form a concave portion in the second negative photosensitive resin on an upper side of the bubble generating chamber; and exposing the second negative photosensitive resin to light to form the second image in the concave portion.

8. The method of manufacturing a liquid ejection head according to claim 7, wherein the negative photosensitive resin is made of a cation-polymerizable photocurable resin, and wherein the cation-polymerizable photocurable resin is added with a photosensitizer having an absorbance of 0.03 to 0.07/μm with respect to an exposure wavelength.

9. The method of manufacturing a liquid ejection head according to claim 1, wherein the negative photosensitive resin is made of a cation-polymerizable photocurable resin.

10. The method of manufacturing a liquid ejection head according to claim 1, wherein the substrate has a liquid supply opening made of a through-hole for supplying the liquid and the flow path forming member has a liquid flow path communicated with the liquid supply opening and the bubble generating chamber, the method comprising:

providing a soluble resin on the substrate before placing the negative photosensitive resin onto the substrate, to form a mold of the liquid flow path; and forming the bubble generating chamber and the ejection orifice, and thereafter, dissolving the mold to form the liquid flow path.

11. The method of manufacturing a liquid ejection head according to claim 10, wherein the soluble resin is made of polymethylisopropenylketone.

* * * * *